US011798770B2

(12) United States Patent
Machida

(10) Patent No.: US 11,798,770 B2
(45) Date of Patent: Oct. 24, 2023

(54) MICROWAVE TUBE AND METHOD FOR CONTROLLING THE SAME

(71) Applicant: NEC NETWORK AND SENSOR SYSTEMS, LTD., Fuchu (JP)

(72) Inventor: Tetsuo Machida, Tokyo (JP)

(73) Assignee: NEC Network and Sensor Systems, Ltd., Tokyo (JP)

( * ) Notice: Subject to any disclaimer, the term of this patent is extended or adjusted under 35 U.S.C. 154(b) by 0 days.

(21) Appl. No.: 17/779,342

(22) PCT Filed: Dec. 1, 2020

(86) PCT No.: PCT/JP2020/044669

§ 371 (c)(1),
(2) Date: May 24, 2022

(87) PCT Pub. No.: WO2021/112081

PCT Pub. Date: Jun. 10, 2021

(65) Prior Publication Data

US 2022/0399178 A1 Dec. 15, 2022

(30) Foreign Application Priority Data

Dec. 3, 2019 (JP) ..... 2019-218548

(51) Int. Cl.
*H01J 23/087* (2006.01)
*H01J 23/06* (2006.01)
*H01J 23/027* (2006.01)

(52) U.S. Cl.
CPC ..... *H01J 23/087* (2013.01); *H01J 23/027* (2013.01); *H01J 23/06* (2013.01)

(58) Field of Classification Search
CPC ..... H01J 23/087; H01J 23/027; H01J 23/06
See application file for complete search history.

(56) References Cited

U.S. PATENT DOCUMENTS

| | | | |
|---|---|---|---|
| 5,694,005 | A | 12/1997 | Goebel |
| 2007/0200506 | A1 | 8/2007 | Miyake |
| 2019/0318904 | A1 | 10/2019 | Yamamoto |

FOREIGN PATENT DOCUMENTS

| | | | |
|---|---|---|---|
| JP | S36-19323 | B2 | 10/1961 |
| JP | H09-180641 | A | 7/1997 |
| JP | H09-237582 | A | 9/1997 |
| JP | 2000-243305 | A | 9/2000 |

(Continued)

OTHER PUBLICATIONS

1 JP Office Communication for JP Application No. 2021-562656, dated Feb. 28, 2023 with English Translation.

(Continued)

*Primary Examiner* — Joseph L Williams

(57) ABSTRACT

A microwave tube includes an electron gun that emits an electron beam; a magnetic circuit that focuses the electron beam emitted from the electron gun; a collector that captures the electron beam that has passed through the magnetic circuit; a high frequency circuit that is spirally arranged around the electron beam focused by the magnetic circuit and that transmits a high frequency; and a magnetic body part arranged around the electron gun so as to be movable in an emission direction of the electron beam. A high frequency output from the high frequency circuit is controlled to be constant by moving the magnetic body part in an emission direction of the electron beam.

20 Claims, 5 Drawing Sheets

(56) References Cited

FOREIGN PATENT DOCUMENTS

| | | | |
|---|---|---|---|
| JP | 2007-234344 | A | 9/2007 |
| JP | 2007-267083 | A | 10/2007 |
| JP | 2007-273158 | A | 10/2007 |
| JP | 2019-186104 | A | 10/2019 |

OTHER PUBLICATIONS

International Search Report for PCT Application No. PCT/JP2020/044669, dated Feb. 22, 2021.

MICROWAVE TUBE AND METHOD FOR CONTROLLING THE SAME

This application is a National Stage Entry of PCT/JP2020/044669 filed on Dec. 1, 2020, which claims priority from Japanese Patent Application 2019-218548 filed on Dec. 3, 2019, the contents of all of which are incorporated herein by reference, in their entirety.

FIELD

Reference To Related Application

The present invention is based on claiming priority of Japanese Patent Application: JP2019-218548 (filed on Dec. 3, 2019), the entire contents of the present application shall be incorporated and stated in the present application by reference thereto.

The present invention relates to a microwave tube and method for controlling the same.

BACKGROUND

There is a microwave tube as means for amplifying an electromagnetic wave (high frequency) in the microwave band (0.3 to 300 GHz). The microwave tube amplifies and outputs a high frequency entered from the microwave tube by causing the high frequency to interact with an electron beam emitted from an electron gun. For instance, as shown in FIG. 5, as a microwave tube, there is a microwave tube 1 comprises: an electron gun 10 that emits an electron beam 2; a magnetic circuit 40 that focuses the electron beam 2 emitted from the electron gun 10; a collector 30 that captures the electron beam 2 that has passed through the magnetic circuit 40; and a high frequency circuit 50 that is spirally arranged around the electron beam 2 focused by the magnetic circuit 40 and that transmits a high frequency (for instance, refer to Patent Literature (PTL) 1). In such a microwave tube 1, the high frequency supplied from an inlet 51 of the high frequency circuit 50, is amplified by interacting with the electron beam 2 to be output from an outlet 52 of the high frequency circuit 50.

This microwave tube 1 has the following problems. For instance, the amount of the electron beam 2 emitted from the electron gun 10 decreases due to the aging of the electron gun 10 as the operating time of the electron gun 10 elapses, and the high frequency amplification effect also decreases according to this change. Also, according to the ambient temperature, the magnetic flux density generated in the magnetic circuit 40 increases or decreases, and the high frequency amplification effect increases or decreases. Further, the magnetic flux density of the magnetic circuit 40 decreases as the operating time of the magnetic circuit 40 elapses, so the diameter of the electron beam 2 enlarges as the operating time of the magnetic circuit 40 elapses, thereby the amount of the electron beam 2 colliding with the high frequency circuit 50 increases. This will shorten the lifespan of the microwave tube 1.

In order to solve these problems, as shown in FIG. 5, an auxiliary electromagnet 60 may be arranged around the electron gun 10 (for instance, refer to PTL 2). It becomes possible to adjust the diameter of the electron beam and the high frequency output by changing the generated magnetic flux density using the auxiliary electromagnet 60.

[PTL 1] JP2007-234344A
[PTL 2] JP09-237582A

SUMMARY

The following analysis is given by the inventor of the present application.

However, in the microwave tube 1 having the auxiliary electromagnet 60, keeping high frequency output constant for a long period of time can get hard because the magnetic flux density generated by the auxiliary electromagnet 60 decreases due to the heat generated by the auxiliary electromagnet 60. Also, in PTL 2, the increase/decrease of the high frequency amplification effect is suppressed by decreasing the current flowing in the auxiliary electromagnet 60 and making the position of the electron gun 10 adjustable in the axial direction, however, this will complicate the structure and adjustment (control) since both the current flowing in the auxiliary electromagnet 60 and the position of the electron gun 10 must be adjusted. Further, in the structure adjusting the position of the electron gun 10, the moving distance of the electron beam 2 changes, thereby keeping high frequency output constant for a long period of time can get hard.

It is a main object of the present invention to provide a microwave tube that can contribute to keeping the high frequency output of the microwave tube constant for a long period of time without complex structure or adjustment and a method for controlling the same.

A microwave tube relating to a first aspect is configured to comprise: an electron gun that emits an electron beam; a magnetic circuit that focuses the electron beam emitted from the electron gun; a collector that captures the electron beam that has passed through the magnetic circuit; a high frequency circuit that is spirally arranged around the electron beam focused by the magnetic circuit and that transmits a high frequency; and a magnetic body part arranged around the electron gun so as to be movable in an emission direction of the electron beam, and to control a high frequency output from the high frequency circuit to be constant by moving the magnetic body part in an emission direction of the electron beam.

A method for controlling a microwave tube, relating to a second aspect is a method for controlling a microwave tube, wherein the microwave tube comprises: an electron gun that emits an electron beam; a magnetic circuit that focuses the electron beam emitted from the electron gun; a collector that captures the electron beam that has passed through the magnetic circuit; a high frequency circuit that is spirally arranged around the electron beam focused by the magnetic circuit and that transmits a high frequency; and a magnetic body part arranged around the electron gun so as to be movable in an emission direction of the electron beam, and wherein the method comprises controlling a high frequency output from the high frequency circuit to be constant by moving the magnetic body part in an emission direction of the electron beam.

According to the first and second aspects, it is possible to contribute to keeping the high frequency output of a microwave tube constant for a long period of time without complex structure or adjustment.

PREFERRED MODES

Figure 1:
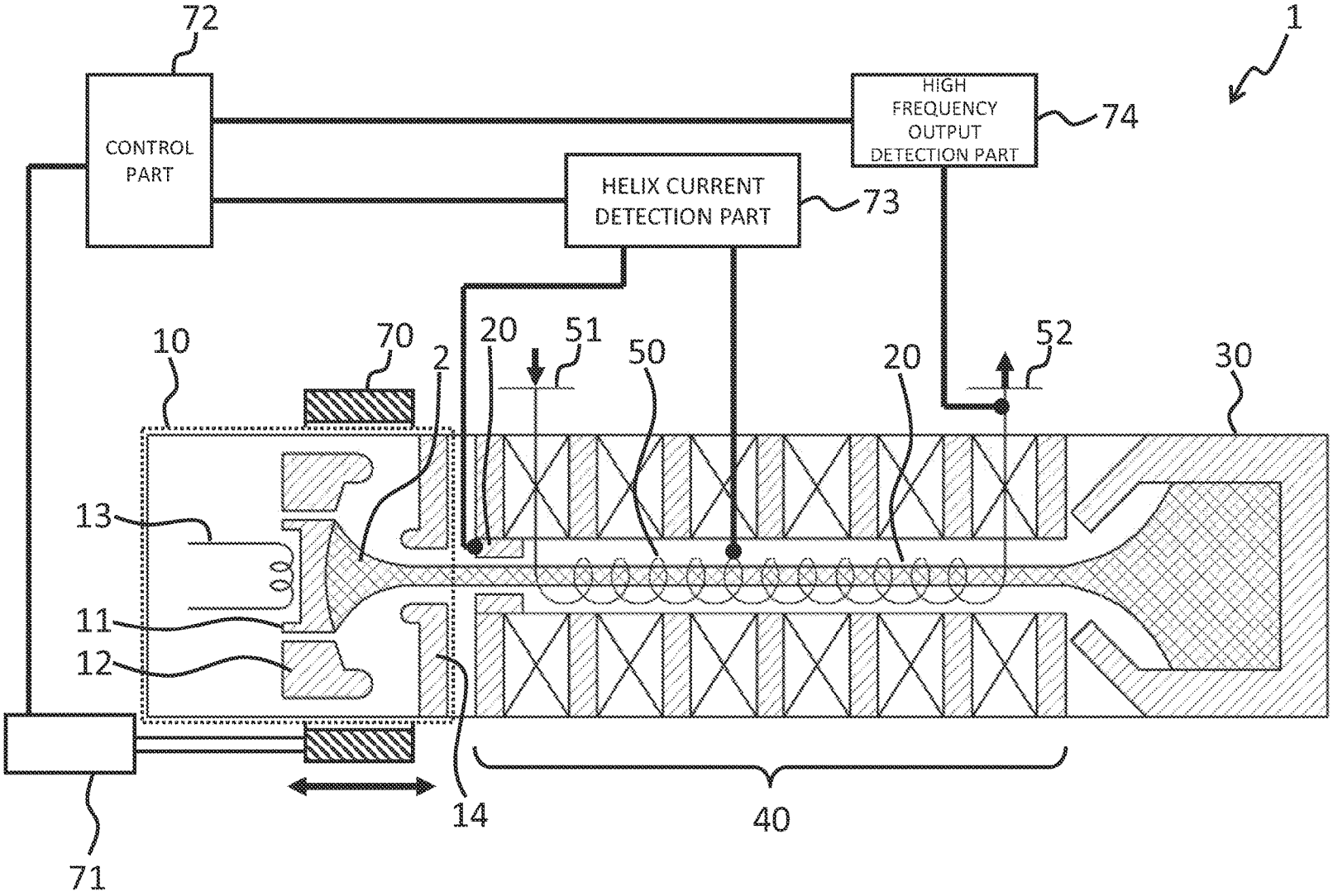
FIG. 1 is a cross section schematically showing a configuration of a microwave tube relating to a first example embodiment.

In the present disclosure described below, a microwave tube relating to mode 1 and the modified modes thereof can be appropriately selected and combined.

The microwave tube relating to the mode 1 can be configured to comprise: an electron gun that emits an electron beam; a magnetic circuit that focuses the electron beam emitted from the electron gun; a collector that captures the electron beam that has passed through the magnetic circuit; a high frequency circuit that is spirally arranged around the electron beam focused by the magnetic circuit and that transmits a high frequency; and a magnetic body part arranged around the electron gun so as to be movable in an emission direction of the electron beam, wherein a high frequency output from the high frequency circuit is controlled to be constant by moving the magnetic body part in an emission direction of the electron beam.

As a modified mode of the microwave tube relating to the mode 1, the microwave tube can further comprise a position movement mechanism capable of moving a position of the magnetic body part in the emission direction of the electron beam.

As a modified mode of the microwave tube relating to the mode 1, the microwave tube can further comprise a control part that controls operation of the position movement mechanism.

As a modified mode of the microwave tube relating to the mode 1, the microwave tube can further comprise a helix current detection part that detects a helix current generated when the electron beam collides with the high frequency circuit, wherein the control part can control the operation of the position movement mechanism at least based on the helix current detected by the helix current detection part.

As a modified mode of the microwave tube relating to the mode 1, the microwave tube can further comprise a beam cutter that regulates the electron beam emitted from the electron gun so that the electron beam does not enter the high frequency circuit, wherein the helix current detection part can detect the helix current flowing between the high frequency circuit and the beam cutter.

As a modified mode of the microwave tube relating to the mode 1, the control part controls the position of the magnetic body part to become closer to the magnetic circuit until the helix current reaches a first target value when the helix current detected by the helix current detection part rises.

As a modified mode of the microwave tube relating to the mode 1, the microwave tube can further comprise a high frequency output detection part that detects a level of the high frequency output from the high frequency circuit, and the control part can control the position of the magnetic body part using the position movement mechanism at least based on the high frequency output level detected by the high frequency output detection part.

As a modified mode of the microwave tube relating to the mode 1, the control part can control the position of the magnetic body part to become closer to the magnetic circuit until the high frequency output level reaches a second target value when the high frequency output level detected by the high frequency output detection part drops.

In the present disclosure, as a method for controlling a microwave tube, relating to mode 2, a method for controlling a microwave tube is provided, wherein the microwave tube comprises: an electron gun that emits an electron beam; a magnetic circuit that focuses the electron beam emitted from the electron gun; a collector that captures the electron beam that has passed through the magnetic circuit; a high frequency circuit that is spirally arranged around the electron beam focused by the magnetic circuit and that transmits a high frequency; and a magnetic body part arranged around the electron gun so as to be movable in an emission direction of the electron beam, and wherein the method can comprise controlling a high frequency output from the high frequency circuit to be constant by moving the magnetic body part in an emission direction of the electron beam.

As a modified mode of the method for controlling a microwave tube, relating to the mode 2, the method can include controlling the position of the magnetic body part to become closer to the magnetic circuit until the helix current generated due to a collision between the electron beam and the high frequency circuit or the high frequency output level from the high frequency circuit reaches a target value, when a helix current rises or the high frequency output level drops.

Example embodiments will be described below with reference to the drawings. When the drawing reference signs are attached in this application, it should be noted that the drawing reference signs herein are given mainly to facilitate understanding and are not intended to limit the present invention to the illustrated aspects. Also, the following example embodiments are merely examples and do not limit the present invention.

First Example Embodiment

A microwave tube relating to a first example embodiment will be described with reference to the drawings. FIG. 1 is a cross section schematically showing a configuration of the microwave tube relating to the first example embodiment.

The microwave tube 1 is an electron tube that amplifies a supplied high frequency by causing it to interact with an electron beam 2 emitted from an electron gun 10 to output the result. The microwave tube 1 comprises: the electron gun 10; a beam cutter 20; a collector 30; a magnetic circuit 40; and a high frequency circuit 50 in a sealed space (vacuum). Also, as means for keeping high frequency output constant for a long period of time, the microwave tube 1 comprises: a magnetic body part 70; a position movement mechanism 71; a control part 72; a helix current detection part 73; and a high frequency output detection part 74.

The electron gun 10 is a device (apparatus) that (linearly) emits the electron beam 2. The electron gun 10 is arranged on the opposite side relative to the collector 30 side of the magnetic circuit 40. As the electron gun 10, for instance, a thermionic emission type electron gun may be used, wherein electrons inside a cathode 11 (emitter) heated by a heater 13 are emitted into space, the emitted electrons are focalized by a wehnelt 12 to form the electron beam 2, and the formed electron beam 2 is accelerated by the potential difference between the cathode 11 and an anode 14 to be guided to the beam cutter 20. A body voltage, which is a negative DC voltage with respect to the potential of the high frequency circuit 50, is supplied to each of the cathode 11 and the wehnelt 12. A heater voltage, which is a positive or negative DC voltage with respect to the potential of the cathode 11, is supplied to the heater 13. An anode voltage, which is a positive DC voltage with respect to the potential of the cathode 11, is supplied to the anode 14.

The beam cutter 20 is an annular member that regulates the electron beam 2 emitted from the electron gun 10 so that the electron beam 2 does not enter the high frequency circuit 50. The beam cutter 20 is arranged inside the magnetic circuit 40 between the electron gun 10 and the high frequency circuit 50. As the beam cutter 20, a metal material having a heat capacity larger than that of the high frequency circuit 50 may be used. The beam cutter 20 collides with the electron beam 2 scattered outside the inner diameter of the helix portion of the high frequency circuit 50 and prevents the scattered electron beam 2 from entering the high frequency circuit 50. The beam cutter 20 is electrically connected to the helix current detection part 73.

The collector 30 is an electrode that captures the electron beam 2 that has passed through the high frequency circuit 50. The collector 30 is arranged on the opposite side relative to the electron gun 10 side of the magnetic circuit 40. A collector voltage, which is a positive DC voltage with respect to the potential of the cathode 11, is supplied to the collector 30.

The magnetic circuit 40 is a circuit (periodic magnetic device) that focuses the electron beam 2 emitted from the electron gun 10 over the entire length of the high frequency circuit 50 using magnetism. The magnetic circuit 40 is arranged outside the periphery of the helix portion of the high frequency circuit 50. The beam cutter 20 is arranged closer to the electron gun 10 side than the helix portion of the high frequency circuit 50 inside the magnetic circuit 40. As the magnetic circuit 40, an electromagnet and/or a permanent magnet may be used.

The high frequency circuit 50 is a circuit (helix circuit) that is spirally arranged around the electron beam 2 that has passed through the beam cutter 20 and that transmits a high frequency. The helix portion of the high frequency circuit 50 is arranged between the electron beam 2 and the magnetic circuit 40. As the high frequency circuit 50, a conductor can be used. In the high frequency circuit 50, a high frequency fed to an inlet 51 of the high frequency circuit 50 is transmitted through the helix portion of the high frequency circuit 50 and outputted from an outlet 52 of the high frequency circuit 50. The high frequency circuit 50 amplifies and outputs the high frequency when the high frequency travels through the helix portion of the high frequency circuit 50 by interacting with the electron beam 2 that has passed through the beam cutter 20 (the kinetic energy of the electron beam is converted into microwave energy). The high frequency circuit 50 is electrically connected to the helix current detection part 73. The high frequency circuit 50 is electrically connected to the high frequency output detection part 74.

The magnetic body part 70 is a part comprising a magnetic body that focuses the electron beam 2 emitted from the electron gun 10 (mainly from the cathode 11). As the magnetic body part 70, a permanent magnet may be used. The magnetic body part 70 is arranged around the electron gun 10 and is movable in the axial direction (the emission direction of the electron beam 2). The magnetic body part 70 is moved in the axial direction by the position movement mechanism 71. The axial position or length focusing the electron beam 2 emitted from the cathode 11 can be adjusted by moving the magnetic body part 70 in the axial direction. When changing the axial position of the magnetic body part 70, the diameter of the electron beam changes by changing in the magnetic field affecting the cathode 11. This influences the interaction between the electron beam 2 and a high frequency travelling through the high frequency circuit 50, thereby the high frequency output of the microwave tube 1 changes.

The position movement mechanism 71 is a mechanism capable of moving a position of the magnetic body part 70 in the axial direction. As the position movement mechanism 71, for instance, a combination of a rack and pinion mechanism and a motor, or a solenoid may be used. The operation of the position movement mechanism 71 is controlled by the control part 72.

The control part 72 is a function part that controls the operation of the position movement mechanism 71. As the control part 72, for instance, an integrated circuit may be used. The control part 72 stores a database organizing the output change amount (change amount of high frequency output) relative to the position of the magnetic body part 70 and a corresponding relationship with the electron beam diameter. The control part 72 is electrically connected to the helix current detection part 73 and monitors a current (helix current) generated when the electron beam 2 collides with the high frequency circuit 50 using the helix current detection part 73. The control part 72 is electrically connected to the high frequency output detection part 74 and monitors the high frequency output level from the outlet 52 of the high frequency circuit 50 using the high frequency output detection part 74. The control part 72 controls the position of the magnetic body part 70 using the position movement mechanism 71 based on the monitored helix current and high frequency output level. When the helix current rises or the high frequency output level drops, the control part 72 controls the position of the magnetic body part 70 closer to the magnetic circuit 40 until the helix current or the high frequency output level reaches a target value.

Here, since the control part 72 already knows a corresponding relationship with the high frequency output and the helix current relative to the position of the magnetic body part 70, the control part 72 controls so as to move the position of the magnetic body part 70 according to a change of the high frequency output or the helix current until the high frequency output or the helix current reaches a target value. By performing such a control routine, the high frequency output can be kept constant and an increase in the helix current can be suppressed.

The helix current detection part 73 is a function part that detects the current (helix current) generated when the electron beam 2 collides with the high frequency circuit 50. The helix current detection part 73 is electrically connected to the high frequency circuit 50 and the beam cutter 20. The helix current detection part 73 detects the helix current flowing between the high frequency circuit 50 and the beam cutter 20 and provides the value of the detected helix current to the control part 72.

The high frequency output detection part 74 is a function part that detects the high frequency output level from the outlet 52 of the high frequency circuit 50. The high frequency output detection part 74 is electrically connected to an area near the outlet 52 of the high frequency circuit 50. The high frequency output detection part 74 provides the value of the detected high frequency output level to the control part 72.

Figure 2:
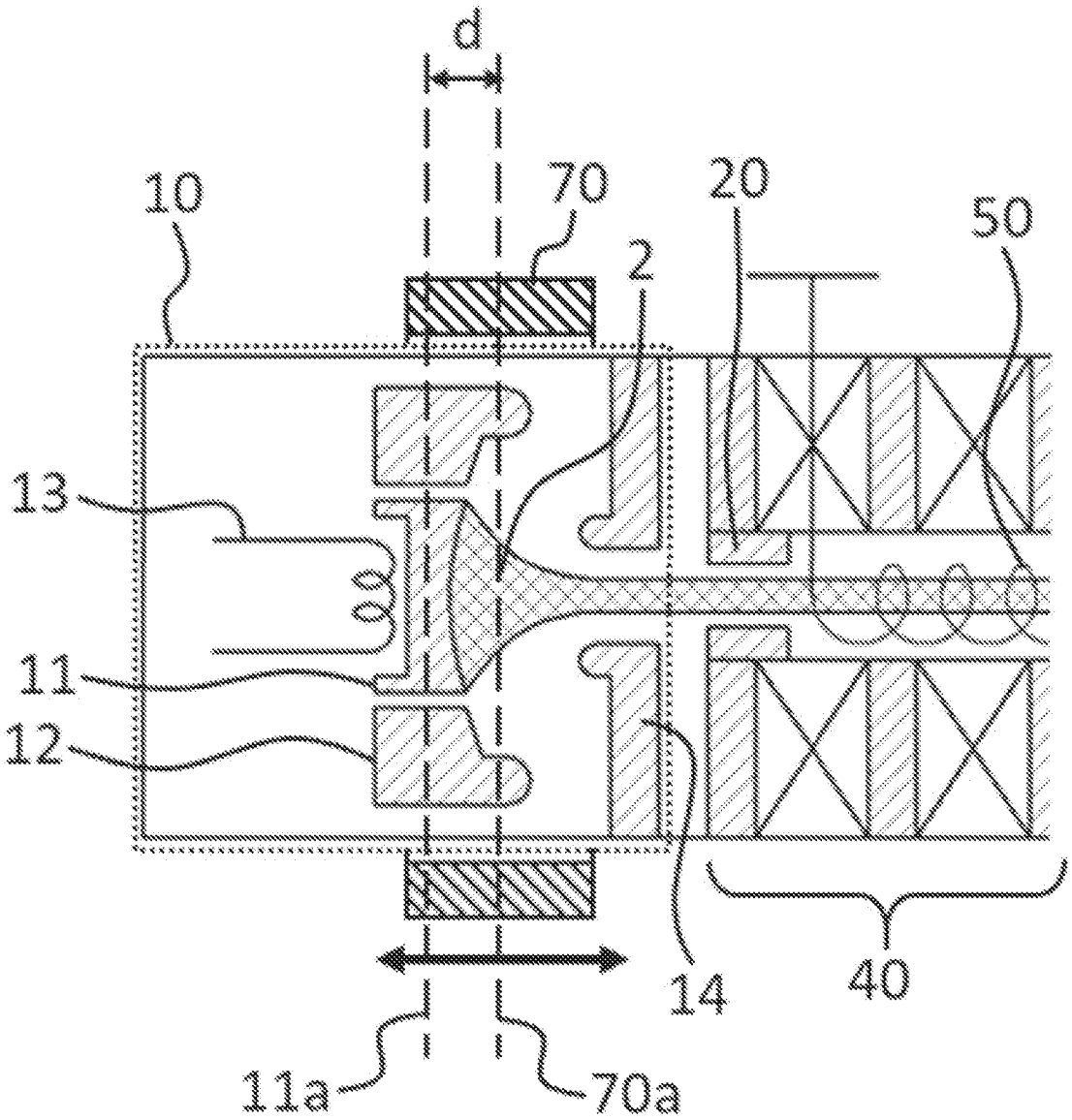
FIG. 2 is a schematic diagram for explaining an axial distance "d" between a magnetic body part and a cathode in the microwave tube relating to the first example embodiment.
Figure 3:
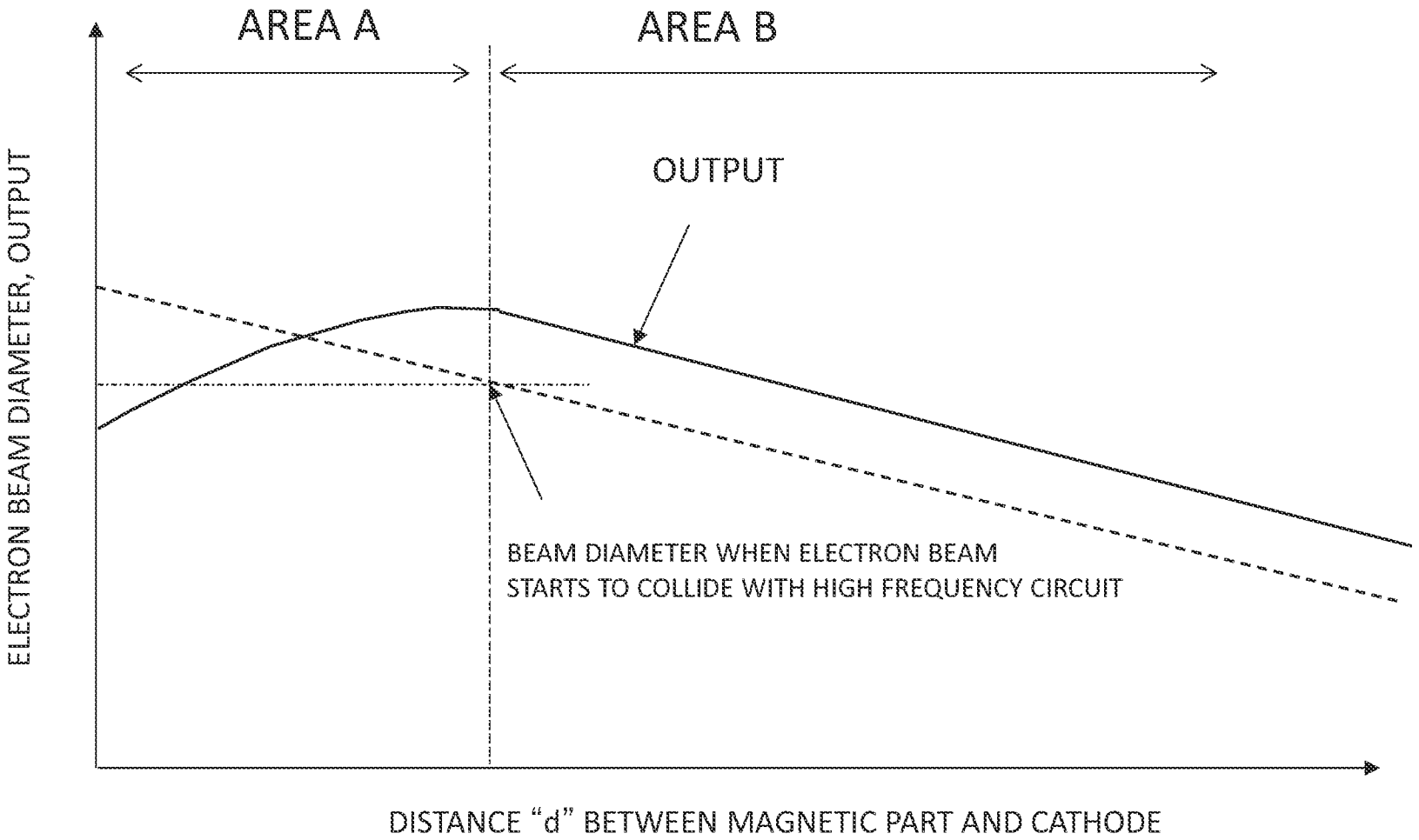
FIG. 3 is a graph schematically showing the relationship between the axial distance "d" between the magnetic body part and the cathode and the beam diameter and the output in the microwave tube relating to the first example embodiment.

Next, With reference to the drawings, the following will describe the relationship between an axial distance "d" between the magnetic body part and the cathode and the beam diameter and the output in the microwave tube relating to the first example embodiment. FIG. 2 is a schematic diagram for explaining the axial distance "d" between the magnetic body part and the cathode in the microwave tube relating to the first example embodiment. FIG. 3 is a graph schematically showing the relationship between the axial distance "d" between the magnetic body part and the cathode and the beam diameter and the output in the microwave tube relating to the first example embodiment.

As shown in FIG. 2, when the axial distance between the magnetic body part 70 and the cathode 11 is defined as the distance "d" between an axial center line 70*a* passing through the axial center of the magnetic body part 70 and an axial center line 11*a* passing through the axial center of the cathode 11, the electron beam diameter and the high frequency output change according to changes in the distance "d" as shown in FIG. 3.

In an area "A" of FIG. 3, since the high frequency output rises as the distance "d" increases, it is possible to control the high frequency output so as to be increased by moving the magnetic body part 70 so as to increase the distance "d".

In an area "B" of FIG. 3, since the high frequency output decreases as the distance "d" increases, it is possible to control the high frequency output so as to be increased by moving the magnetic body part 70 so as to decrease the distance "d".

According to the first example embodiment, it is possible to contribute to keeping the high frequency output of the microwave tube 1 constant for a long period of time without complex structure or adjustment since the high frequency output thereof can be adjusted by controlling the position of the magnetic body part 70 using the position movement mechanism 71 during the operation of the microwave tube 1.

Also, according to the first example embodiment, since the high frequency output of the microwave tube 1 can be adjusted while the helix current and the high frequency output level are monitored, it becomes possible to keep the high frequency output constant regardless of changes in the ambient temperature (changes in the magnetic flux density temperature of the magnetic circuit 40). Further, since the high frequency output of the microwave tube 1 can be adjusted while the helix current and the high frequency output level are monitored, an increase in the helix current over time (due to the aging of the magnetic circuit 40) can be suppressed and the microwave tube can be operated stably for a long period of time. Furthermore, according to the first example embodiment, since the high frequency output of the microwave tube 1 can be adjusted while the helix current and the high frequency output level are monitored, it is possible to mitigate the high load state (high helix current) at the start-up of the microwave tube 1. In addition, by setting the priority and acceptable ranges of the effects described above and prioritizing control of high-priority effect within the acceptable ranges, the high frequency output can be kept constant without any control routine failure even between conflicting effects.

Second Example Embodiment

Figure 4:
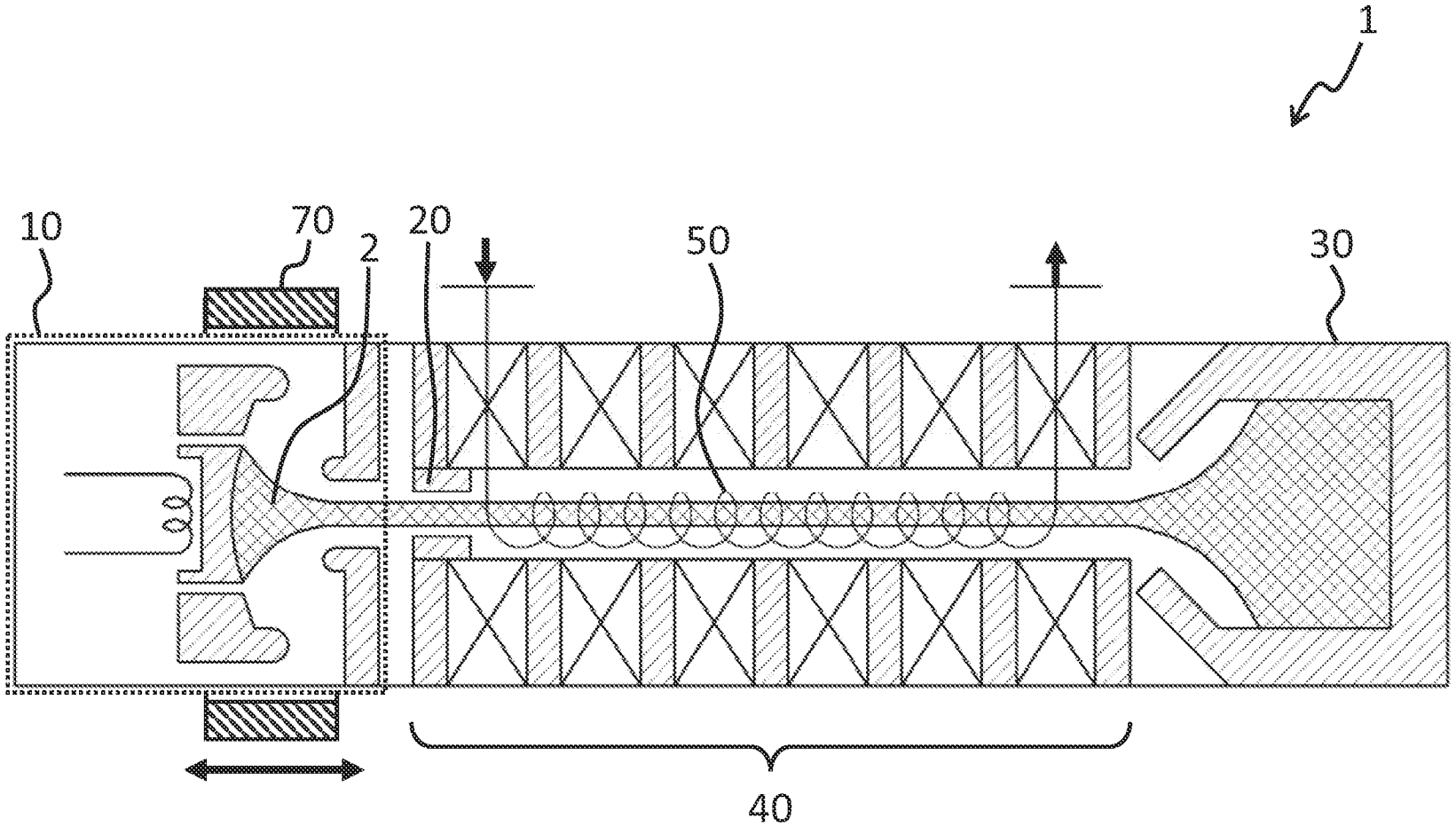
FIG. 4 is a cross section schematically showing a configuration of a microwave tube relating to a second example embodiment
Figure 5:
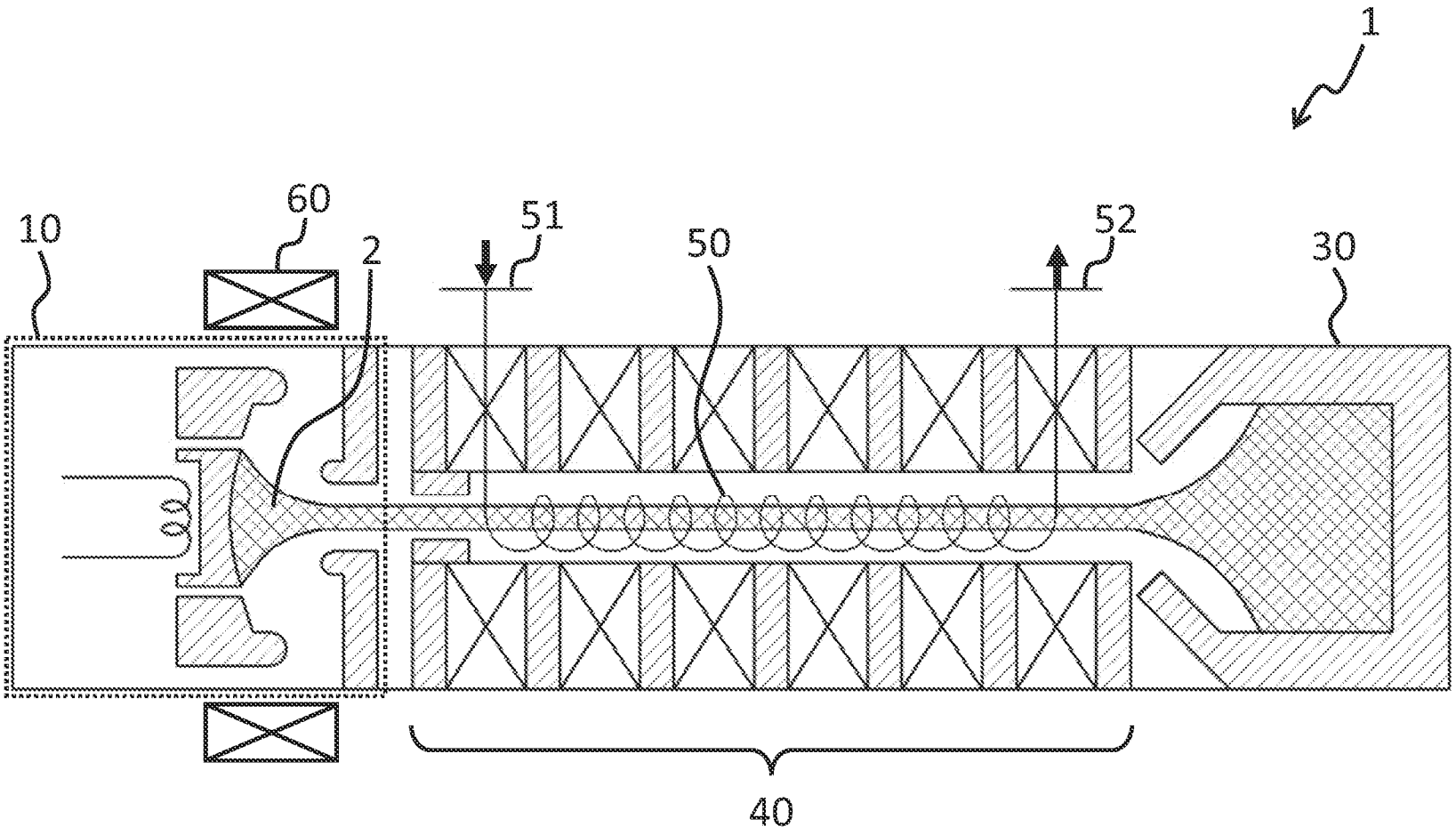
FIG. 5 is a cross section schematically showing a configuration of a microwave tube relating to a conventional example.

A microwave tube relating to a second example embodiment will be described with reference to a drawing. FIG. 4 is a cross section schematically showing a configuration of the microwave tube relating to the second example embodiment.

The microwave tube 1 is an electron tube that amplifies and outputs a supplied high frequency by causing the high frequency to interact with an electron beam 2 emitted from an electron gun 10. The microwave tube 1 comprises: the electron gun 10; a beam cutter 20; a collector 30; a magnetic circuit 40; a high frequency circuit 50; and a magnetic body part 70.

The electron gun 10 emits the electron beam 2. The magnetic circuit 40 focuses the electron beam 2 emitted from the electron gun 10. The collector captures the electron beam 2 that has passed through the magnetic circuit 40. The high frequency circuit 50 is spirally arranged around the electron beam 2 focused by the magnetic circuit 40 and transmits a high frequency. The magnetic body part 70 is arranged around the electron gun 10 so as to be movable in an emission direction of the electron beam.

The microwave tube 1 is configured to control a high frequency output from the high frequency circuit 50 is controlled to be constant by moving the magnetic body part 70 in the emission direction of the electron beam 2.

According to the second example embodiment, it is possible to contribute to keeping the high frequency output of the microwave tube 1 constant for a long period of time without complex structure or adjustment since the high frequency output thereof can be adjusted by controlling the position of the magnetic body part 70 during the operation of the microwave tube 1.

Some or all of the example embodiments above can be described as (but not limited to) the following Modes.

[Mode 1]

A microwave tube, comprising:

- an electron gun that emits an electron beam;
- a magnetic circuit that focuses the electron beam emitted from the electron gun;
- a collector that captures the electron beam that has passed through the magnetic circuit;
- a high frequency circuit that is spirally arranged around the electron beam focused by the magnetic circuit and that transmits a high frequency; and
- a magnetic body part arranged around the electron gun so as to be movable in an emission direction of the electron beam, wherein a high frequency output from the high frequency circuit is controlled to be constant by moving the magnetic body part in an emission direction of the electron beam.

[Mode 2]

The microwave tube according to Mode 1, further comprising a position movement mechanism capable of moving a position of the magnetic body part in the emission direction of the electron beam.

[Mode 3]

The microwave tube according to Mode 2, further comprising a control part that controls operation of the position movement mechanism.

[Mode 4]

The microwave tube according to Mode 3, further comprising a helix current detection part that detects a helix current generated when the electron beam collides with the high frequency circuit, wherein the control part controls the operation of the position movement mechanism at least based on the helix current detected by the helix current detection part.

[Mode 5]

The microwave tube according to Mode 4, further comprising a beam cutter that regulates the electron beam emitted from the electron gun so that the electron beam does not enter the high frequency circuit, wherein the helix current detection part detects the helix current flowing between the high frequency circuit and the beam cutter.

[Mode 6]
The microwave tube according to Mode 4 or 5, wherein the control part controls the position of the magnetic body part to become closer to the magnetic circuit until the helix current reaches a first target value when the helix current detected by the helix current detection part rises.

[Mode 7]
The microwave tube according to any one of Modes 3 to 6 further comprising a high frequency output detection part that detects a level of the high frequency output from the high frequency circuit, wherein the control part controls the position of the magnetic body part using the position movement mechanism at least based on the high frequency output level detected by the high frequency output detection part.

[Mode 8] The microwave tube according to Mode 7, wherein the control part controls the position of the magnetic body part to become closer to the magnetic circuit until the high frequency output level reaches a second target value when the high frequency output level detected by the high frequency output detection part drops.

[Mode 9]
A method for controlling a microwave tube, wherein the microwave tube comprises:

an electron gun that emits an electron beam;

a magnetic circuit that focuses the electron beam emitted from the electron gun;

a collector that captures the electron beam that has passed through the magnetic circuit;

a high frequency circuit that is spirally arranged around the electron beam focused by the magnetic circuit and that transmits a high frequency; and a magnetic body part arranged around the electron gun so as to be movable in an emission direction of the electron beam, and wherein the method comprises controlling a high frequency output from the high frequency circuit to be constant by moving the magnetic body part in an emission direction of the electron beam.

[Mode 10]
The method for controlling the microwave tube, according to Mode 9, comprising controlling a position of the magnetic body part to become closer to the magnetic circuit until a helix current generated due to a collision between the electron beam and the high frequency circuit or a level of the high frequency output from the high frequency circuit reaches a target value when the helix current rises or the high frequency output level drops.

The disclosures of Patent Literatures cited above shall be incorporated and described into the present application by reference thereto and can be used as a basis or a part of the present invention as needed. It is to be noted that it is possible to modify or adjust the example embodiments or examples within the scope of the whole disclosure of the present invention (including the Claims and the figures) based on the basic technical concept thereof. Also, it is possible to variously combine or select (or deselect if necessary) a wide variety of the disclosed elements (including the individual elements of the individual claims, the individual elements of the individual example embodiments or examples, the individual elements of the individual figures and the like) within the scope of the whole disclosure of the present invention. That is, it is self-explanatory that the present invention includes any types of variations and modifications to be achieved by a skilled person according to the whole disclosure including the Claims and the figures, and the technical concept of the present invention. Further, as to any numerical values or ranges disclosed herein, any intermediate or lower values or subranges should be described even if there is no clear description. Further, matters using each of the disclosed matters of the above-cited literatures in combination with the matters described in this document in part or in whole as a part of the disclosure of the present invention, in accordance with the purpose of the present invention, if necessary, are regarded to be included in (belonging to) the matters disclosed in the present application.

REFERENCE SIGNS LIST

1: microwave tube
2: electron beam
10: electron gun
11: cathode
11*a*: axial center line
12: wehnelt
13: heater
14: anode
20: beam cutter
30: collector
40: magnetic circuit
50: high frequency circuit
51: inlet
52: outlet
60: auxiliary electromagnet
70: magnetic body part
70*a*: axial center line
71: position movement mechanism
72: control part
73: helix current detection part
74: high frequency output detection part

What is claimed is:

1. A microwave tube, comprising:

an electron gun that emits an electron beam;

a magnetic circuit that focuses the electron beam emitted from the electron gun;

a collector that captures the electron beam that has passed through the magnetic circuit;

a high frequency circuit that is spirally arranged around the electron beam focused by the magnetic circuit and that transmits a high frequency; and a magnetic body part arranged around the electron gun so as to be movable in an emission direction of the electron beam, wherein a high frequency output from the high frequency circuit is controlled to be constant by moving the magnetic body part in an emission direction of the electron beam.

2. The microwave tube according to claim 1, further comprising a position movement mechanism capable of moving a position of the magnetic body part in the emission direction of the electron beam.

3. The microwave tube according to claim 2, further comprising a control part that controls operation of the position movement mechanism.

4. The microwave tube according to claim 3, further comprising a helix current detection part that detects a helix current generated when the electron beam collides with the high frequency circuit, wherein the control part controls the operation of the position movement mechanism at least based on the helix current detected by the helix current detection part.

5. The microwave tube according to claim 4, further comprising a beam cutter that regulates the electron beam emitted from the electron gun so that the electron beam does not enter the high frequency circuit, wherein the helix current detection part detects the helix current flowing between the high frequency circuit and the beam cutter.

6. The microwave tube according to claim 4, wherein the control part controls the position of the magnetic body part to become closer to the magnetic circuit until the helix current reaches a first target value when the helix current detected by the helix current detection part rises.

7. The microwave tube according to claim 3, further comprising a high frequency output detection part that detects a level of the high frequency output from the high frequency circuit, wherein the control part controls the position of the magnetic body part using the position movement mechanism at least based on the high frequency output level detected by the high frequency output detection part.

8. The microwave tube according to claim 7, wherein the control part controls the position of the magnetic body part to become closer to the magnetic circuit until the high frequency output level reaches a second target value when the high frequency output level detected by the high frequency output detection part drops.

9. A method for controlling a microwave tube, wherein the microwave tube comprises:

an electron gun that emits an electron beam;

a magnetic circuit that focuses the electron beam emitted from the electron gun;

a collector that captures the electron beam that has passed through the magnetic circuit;

a high frequency circuit that is spirally arranged around the electron beam focused by the magnetic circuit and that transmits a high frequency; and a magnetic body part arranged around the electron gun so as to be movable in an emission direction of the electron beam, and wherein the method comprises controlling a high frequency output from the high frequency circuit to be constant by moving the magnetic body part in an emission direction of the electron beam.

10. The method for controlling the microwave tube, according to claim 9, further comprising controlling a position of the magnetic body part to become closer to the magnetic circuit until a helix current generated due to a collision between the electron beam and the high frequency circuit or a level of the high frequency output from the high frequency circuit reaches a target value, when the helix current rises or the high frequency output level drops.

11. The microwave tube according to claim 5, wherein the control part controls the position of the magnetic body part to become closer to the magnetic circuit until the helix current reaches a first target value when the helix current detected by the helix current detection part rises.

12. The microwave tube according to claim 4, further comprising a high frequency output detection part that detects a level of the high frequency output from the high frequency circuit, wherein the control part controls the position of the magnetic body part using the position movement mechanism at least based on the high frequency output level detected by the high frequency output detection part.

13. The microwave tube according to claim 5, further comprising a high frequency output detection part that detects a level of the high frequency output from the high frequency circuit, wherein the control part controls the position of the magnetic body part using the position movement mechanism at least based on the high frequency output level detected by the high frequency output detection part.

14. The microwave tube according to claim 6, further comprising a high frequency output detection part that detects a level of the high frequency output from the high frequency circuit, wherein the control part controls the position of the magnetic body part using the position movement mechanism at least based on the high frequency output level detected by the high frequency output detection part.

15. The microwave tube according to claim 11, further comprising a high frequency output detection part that detects a level of the high frequency output from the high frequency circuit, wherein the control part controls the position of the magnetic body part using the position movement mechanism at least based on the high frequency output level detected by the high frequency output detection part.

16. The microwave tube according to claim 12, wherein the control part controls the position of the magnetic body part to become closer to the magnetic circuit until the high frequency output level reaches a second target value when the high frequency output level detected by the high frequency output detection part drops.

17. The microwave tube according to claim 13, wherein the control part controls the position of the magnetic body part to become closer to the magnetic circuit until the high frequency output level reaches a second target value when the high frequency output level detected by the high frequency output detection part drops.

18. The microwave tube according to claim 14, wherein the control part controls the position of the magnetic body part to become closer to the magnetic circuit until the high frequency output level reaches a second target value when the high frequency output level detected by the high frequency output detection part drops.

19. The microwave tube according to claim 15, wherein the control part controls the position of the magnetic body part to become closer to the magnetic circuit until the high frequency output level reaches a second target value when the high frequency output level detected by the high frequency output detection part drops.

20. The microwave tube according to claim 5, wherein the beam cutter is configured to use a metal material having a heat capacity larger than that of the high frequency circuit.

* * * * *